US011198167B2

(12) United States Patent
Sohmshetty et al.

(10) Patent No.: US 11,198,167 B2
(45) Date of Patent: Dec. 14, 2021

(54) METHODS FOR DIE TRIMMING HOT STAMPED PARTS AND PARTS FORMED THEREFROM

(71) Applicant: Ford Motor Company, Dearborn, MI (US)

(72) Inventors: Raj Sohmshetty, Canton, MI (US); Constantin Chiriac, Windsor (CA); Mikhail Minevich, Livonia, MI (US); Liang Huang, Troy, MI (US)

(73) Assignee: Ford Motor Company, Dearborn, MI (US)

( * ) Notice: Subject to any disclaimer, the term of this patent is extended or adjusted under 35 U.S.C. 154(b) by 414 days.

(21) Appl. No.: 16/018,506

(22) Filed: Jun. 26, 2018

(65) Prior Publication Data

US 2019/0388948 A1 Dec. 26, 2019

(51) Int. Cl.

| | |
|---|---|
| ***B21D 22/02*** | (2006.01) |
| ***C21D 1/673*** | (2006.01) |
| ***B21D 24/16*** | (2006.01) |
| ***B21D 28/14*** | (2006.01) |

(Continued)

(52) U.S. Cl.

CPC ..... *B21D 22/022* (2013.01); *B21D 24/16* (2013.01); *B21D 28/14* (2013.01); *B21D 37/16* (2013.01); *C21D 1/673* (2013.01); *C21D 11/005* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 7,100,415 | B2 | 9/2006 | Takashima et al. | |
| 10,486,215 | B2 * | 11/2019 | Sohmshetty | B21D 22/02 |
| 2012/0111161 | A1 | 5/2012 | Kuriki et al. | |

(Continued)

FOREIGN PATENT DOCUMENTS

| | | |
|---|---|---|
| DE | 102007008653 | 8/2008 |
| DE | 10248207 | 1/2009 |
| EP | 2308625 | 4/2011 |

OTHER PUBLICATIONS

Zhu et al., "Modeling of Microstructure Evolution in 22MnB5 Steel during Hot Stamping", (2014), Journal of Iron and Steel Research, International. 21(2):197-201 (Year: 2014).*

(Continued)

*Primary Examiner* — Patricia L. Hailey
*Assistant Examiner* — Christopher D. Moody
(74) *Attorney, Agent, or Firm* — Burris Law, PLLC

(57) ABSTRACT

A method of forming a hot stamped, die quenched, and die trimmed part is provided. The method includes hot stamping and die quenching a blank with a quench die and forming a die quenched panel. The quench die includes at least one slow-cooling channel. The die quenched panel is die trimmed along the at least one localized soft zone that is adjacent a hard zone. The blank may be formed from a press hardenable steel (PHS), and the at least one soft zone may have a ferritic microstructure and the at least one hard zone may have a martensitic microstructure. The at least one localized soft zone may have a microhardness between about 200 HV and about 250 HV and the hard zone may have a microhardness between about 400 HV and about 500 HV.

16 Claims, 6 Drawing Sheets

(51) Int. Cl.
*C21D 11/00* (2006.01)
*B21D 37/16* (2006.01)

(56) References Cited

U.S. PATENT DOCUMENTS

| | | | | |
|---|---|---|---|---|
| 2016/0024608 | A1* | 1/2016 | Singh | C21D 1/673 148/653 |
| 2017/0239703 | A1 | 8/2017 | Sohmshetty et al. | |
| 2018/0265944 | A1* | 9/2018 | Skrikerud | C21D 1/673 |
| 2018/0361455 | A1* | 12/2018 | Sohmshetty | B60R 19/03 |

OTHER PUBLICATIONS

Larsson, Linus, Warm Sheet Metal Forming with Localized In-Tool Induction Heating, Research Portal, Lund University, available at URL http://portal.research.lu.se/portal/en/publications/warm-sheet-metal-forming-with-localized-intool-induction-heating(4b645dd5-5c1c-4c4a-9fe5-8d950ea042c9).html.

* cited by examiner

METHODS FOR DIE TRIMMING HOT STAMPED PARTS AND PARTS FORMED THEREFROM

The present disclosure relates to the field of hot forming of steel parts, and more specifically, to hot stamping, die quenching and die trimming of press hardenable steel parts.

BACKGROUND

The statements in this section merely provide background information related to the present disclosure and may not constitute prior art.

Press hardenable steels (PHSs), including boron steels, are often hot stamped for the manufacture of automotive parts. PHSs exhibit high strength such that thicknesses of automotive parts formed from PHSs and vehicle weight may be reduced, and vehicle fuel economy may be increased. Forming a part from PHS generally includes heating and hot stamping a sheet of PHS (also referred to herein as "PHS sheet") in order to reduce a forming load required to form the part and reduce the amount of spring-back exhibited by the PHS sheet. That is, hot stamping increases the formability characteristics of PHS sheets. However, the hot stamped PHS parts must be trimmed to remove unnecessary material from the parts, and due to the increased strength (and hardness) of the PHS, trimming using conventional die trimming results in in severe shearing tool wear, maintenance, and/or frequent replacement.

In an effort to reduce shearing tool wear and/or maintenance costs, hot forming applications of PHS sheets routinely use laser trimming to deliver trimmed parts that meet design intent. However, laser trimming is a relatively expensive and time-consuming process.

The present disclosure addresses the issues associated with trimming harder steels, such as PHS steels, among other issues in the manufacture of such high-strength, lightweight materials.

SUMMARY

In one form of the present disclosure, a method of forming a die quenched part is provided. The method includes hot stamping and die quenching a blank to form a die quenched panel. The blank is die quenched with a quench die comprising at least one slow-cooling channel that reduces the cooling rate of a portion or zone of the blank that is adjacent to the slow-cooling channel. The zone of the blank subject to the reduced cooling rate is locally soft (localized soft zone) compared to an adjacent zone that is subjected to an increased cooling rate and is hard. The die quenched panel is die trimmed along the localized soft zone to form a die trimmed panel. The blank may be formed from a press hardenable steel (PHS) and the localized soft zone may have a Vickers microhardness between about 200 HV and about 250 HV and the hard zone may have a microhardness between about 400 HV and 500 HV. Also, the localized soft zone may have a ferritic microstructure and the hard zone may have a martensitic microstructure. In one aspect, the hard zone may have a temperature less than about 200° C. and the localized soft zone may have a temperature between about 400° C. and about 650° C. during die trimming of the die quenched panel. In some aspects, the die trimmed panel comprises less than about 10% by volume of the localized soft zone and more than about 90% by volume of the hard zone. The blank may have a thickness 't' and the localized soft zone may have a width between about 5 t and about 20 t. The method may further include a step of transferring the die quenched blank from a die quench station to a die trim station using a transfer unit. The transfer unit may have a support for supporting the localized soft zone of the die quenched panel during transfer of the die quench panel from the die quench station to the die trim station. In the alternative, or in addition to, the transfer unit may include a heating unit or heating element for applying heat to the localized soft zone during transfer of the die quench panel.

In another form of the present disclosure, a method of forming a part from press hardenable steel (PHS) includes hot stamping a blank formed from PHS to form a hot stamped PHS blank and die quenching the hot stamped PHS blank at a die quench station to form a die quenched PHS panel. The die quenched PHS panel has at least one localized soft zone with a ferritic microstructure and a hard zone with a martensitic microstructure. The die quenched PHS panel may be transferred from the die quench station to a die trimming station using a transfer unit. The transfer unit may include a support for supporting the at least one localized soft zone and/or a heating element for providing heat to the at least one localized soft zone during the transfer. The die quenched PHS panel is die trimmed along the at least one localized soft zone to form a PHS part and the PHS part is cooled to room temperature. In some aspects, the at least one soft zone occupies less than about 10% by volume of the PHS part and the hard zone occupies more than about 90% by volume of the PHS part. Also, the at least one localized soft zone of the PHS part may have a Vickers microhardness between about 200 HV and about 250 HV and the hard zone of the PHS part may have a microhardness between about 400 HV and about 500 HV. During die trimming of the die quenched PHS panel, the at least one localized soft zone may have a temperature between about 400° C. and about 650° C. and the hard zone may have a temperature between about 25° C. and about 200° C. In some aspects, a die trimmed edge with a ferritic microstructure is formed when the die quenched PHS panel is die trimmed along the at least one localized soft zone.

In still another form of the present disclosure, a part formed from a PHS is provided. The PHS part is formed from a hot stamped, die quenched, and die trimmed PHS sheet, and has at least one localized soft zone comprising a fully ferritic microstructure and a hard zone comprising a fully martensitic microstructure. The at least one localized soft zone is adjacent to die trimmed edges of the PHS part and occupies less than about 10% by volume of the PHS part. The at least one localized soft zone may have a microhardness between about 200 HV and about 250 HV, and the hard zone may have a microhardness between about 400 HV and about 500 HV. In some aspects, the die trimmed edges of the PHS part comprise a ferritic microstructure.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
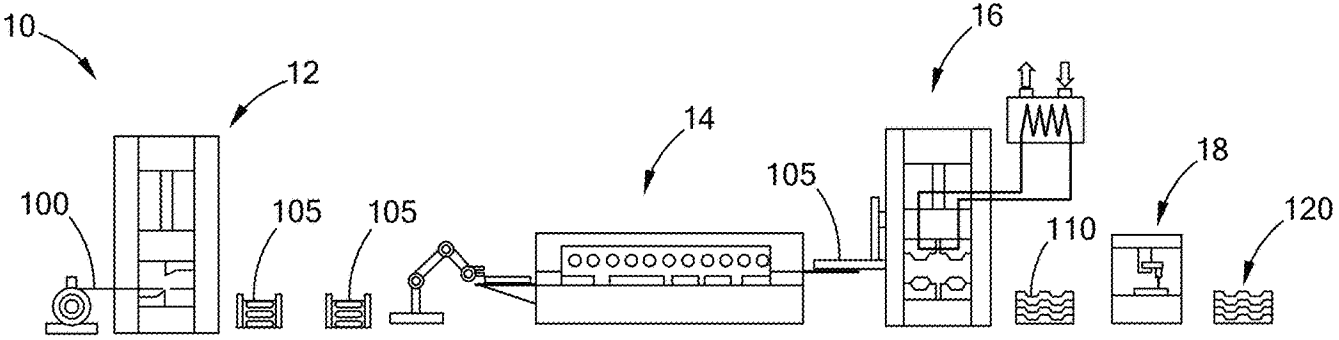
FIG. 1 PRIOR ART
FIG. 1 is a schematic illustration of a traditional manufacturing process for hot stamped press hardenable steel (PHS) according to the prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a prior art process 10 of forming a press hardenable steel (PHS) part 120 is shown. The prior art process 10 generally includes the steps of blanking a PHS sheet 100 and forming PHS blanks 105 at step 12 and transferring and heating the PHS blanks 105 in a furnace at step 14. The heated PHS blanks 105 are transferred to a hot stamping-die quenching station at step 16. Also, the heated PHS blanks 105 are hot stamped and die quenched into a PHS panel 110 at step 16. The PHS panel 110 is transferred to a laser station and laser trimmed to form a PHS part 120 at step 18. Because the PHS panel 110 has high strength and high hardness, conventional metal shearing tools wear out quickly when used to die trim the PHS panels 110 thereby resulting in the need for laser trimming.

As used herein, the phrase "press hardenable steel" refers to a grade of steel that can be heated into the austenitic range of the steel, hot pressed (also referred to herein as "hot stamped" or "hot stamping") and die quenched such that the microstructure of the steel transforms from austenite to martensite. The phrase "austenitic range" as used herein refers to a temperature range for a PHS such that PHS within the temperature range has an austenitic microstructure. The phrase "austenitic microstructure" as used herein refers to a microstructure of a PHS that is at least 90 volume percent (vol. %) austenite, for example between about 95 vol. % and 100 vol. % austenite, between about 98 vol. % and 100 vol. % austenite, or about 100 vol. % austenite. The phrase "martensitic microstructure" as used herein refers to a microstructure of a PHS that is at least 90 volume percent (vol. %) martensite, for example between about 95 vol. % and 100 vol. % martensite, between about 98 vol. % and 100 vo. % martensite, or about 100 vol. % martensite. The phrase "ferritic microstructure" as used herein refers to a microstructure of a PHS that is at least 90 volume percent (vol. %) ferrite plus pearlite and possibly some bainite, for example between about 95 vol. % and 100 vol. % ferrite plus pearlite and possibly some bainite, between about 98 vol. % and 100 vol. % ferrite plus pearlite and possibly some bainite, or about 100 vol. % ferrite plus pearlite and possibly some bainite.

Figure 2:
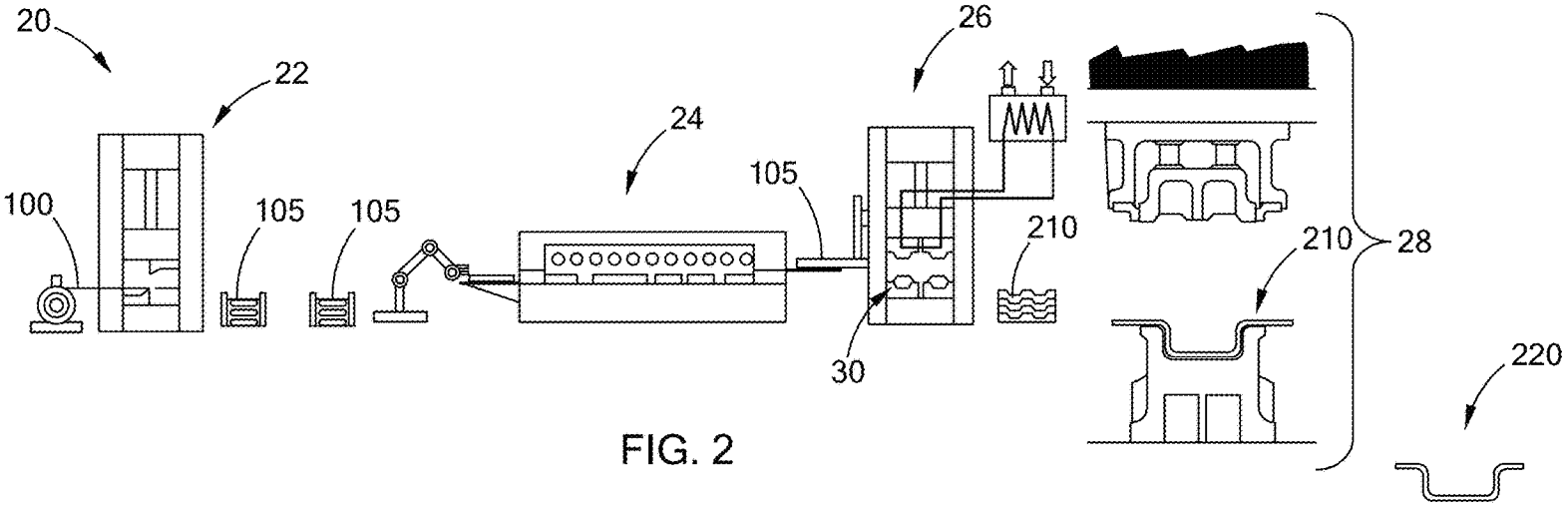
FIG. 2 is a schematic illustration of a manufacturing process for hot stamped PHS according to the teachings of the present disclosure.

Referring now to FIG. 2, a method of forming a part according to the teachings of the present disclosure is illustrated and generally indicated by reference numeral 20. Generally, the method 20 includes the steps of blanking a PHS sheet 100 and forming PHS blanks 105 at step 22, and transferring and heating the PHS blanks 105 in a furnace at step 24. The heated PHS blanks 105 are transferred to a hot stamping-die quenching station at step 26. Also, the heated PHS blanks 105 are hot stamped and die quenched into a PHS panel 210 at step 26. The hot stamping-die quenching station (not labeled) comprises a hot stamping-quench die 30 (also referred to herein simply as a "quench die") with at least one slow-cooling channel (not labeled) described in greater detail below. One or more portions or zones of the PHS blank 105 positioned adjacent to the slow-cooling channels during die quenching have a cooling rate that result in one or more a "soft zones" compared to an adjacent hard portion or hard zone that is cooled with a faster cooling rate. As used herein, the phrase "soft zone" refers to a portion of a PHS sheet, PHS blank, PHS panel and/or PHS part with a Vickers microhardness less than 300 HV, and the phrase "hard zone" refers to a portion of a PHS sheet, PHS blank, PHS panel and/or PHS part with a Vickers microhardness greater than or equal to 400 HV. The PHS panel 210 is transferred to a die trimming station and die trimmed along the one or more soft zones at step 28 to form a PHS part 220. That is, the one or more soft zones allow for conventional die trimming of the PHS panel 210 to form the PHS part 220 without excessive wear of die trim equipment.

Figure 3:
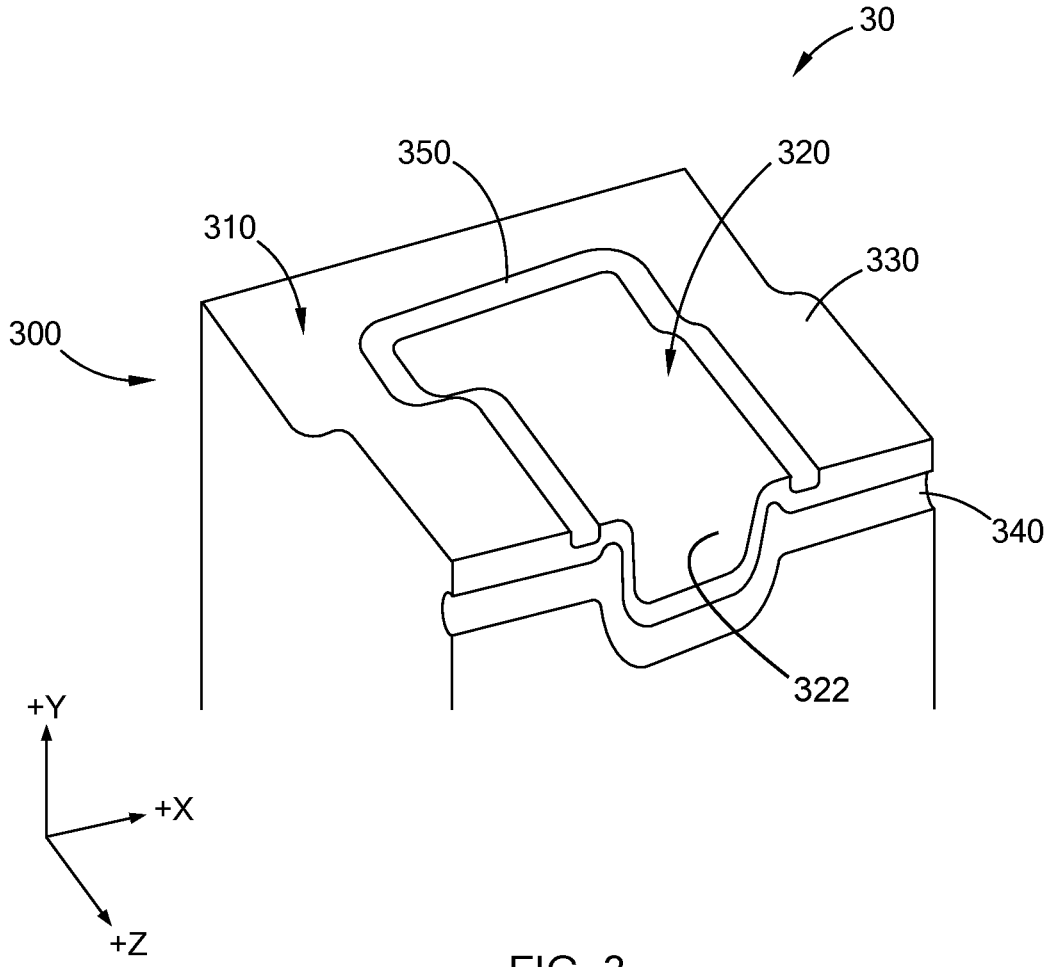
FIG. 3 is a perspective view of a quench die according to one variation in accordance with the teachings of the present disclosure.

Referring now to FIG. 3, in one form of the present disclosure the quench die 30 includes a body 300 with a forming surface 310. The forming surface 310 may include a forming cavity 320 with a cavity surface 322 extending into the body 300 and an upper surface 330 (+Y direction) extending outwardly from the forming cavity 320. As used herein, the term "outwardly" refers to a direction extending away from, as opposed to extending towards, a forming cavity of a quench die disclosed herein. It should be understood that the forming cavity 320 may be complimentary in shape with the PHS panel 210 formed at the hot stamping-die quenching station at step 26 (FIG. 2). That is, the forming cavity 320 may generally have a shape, contour, etc., such that a PHS blank 210 that is hot formed into the forming cavity 320 has the shape of the PHS part 220. The quench die 30 may include at least one cooling channel 340 positioned underneath (−Y direction) the forming surface 310 such that a cooling fluid (not shown) may flow through and extract heat from (i.e., cool) the forming surface 310 before, during and/or after hot stamping the PHS blank 210. While the quench die 30 schematically depicted in FIG. 3 shows a cavity extending downwardly (−Y direction) from the upper surface 330 into the body 300, it should be understood that the quench die 30 may include one or more portions extending upwardly (+Y direction) from the upper surface 330.

Figure 3A:
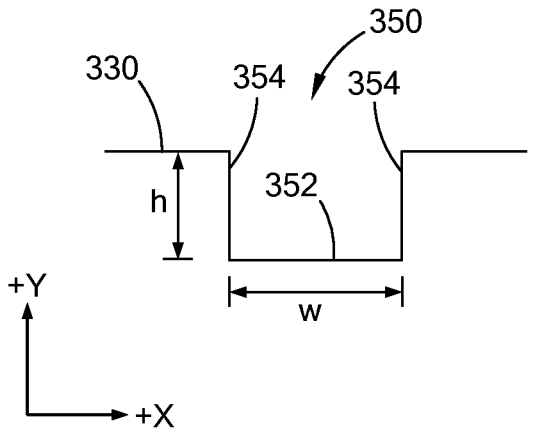
FIG. 3A is a detail view of section A-A in FIG. 3.

Referring now to FIGS. 3 and 3A, the quench die 30 may comprise at least one slow-cooling channel 350. In some aspects, the at least one slow-cooling channel may be positioned outwardly from the forming cavity 320. As used herein, the phrase "slow-cooling channel" refers to a channel or groove with reduced heat transfer properties compared to the cavity surface 322 of the forming cavity 320 and/or the upper surface 330. Accordingly, the slow-cooling channel 350 results in a portion or zone of a heated PHS blank 105 positioned adjacent to the slow-cooling channel 350 during die quenching (step 26) to have a lower cooling rate than a portion of the heated PHS blank 105 positioned adjacent to and in direct contact with the cavity surface 322 and/or upper surface 330. The slow-cooling channel 350 may comprise a lower surface 352 (−Y direction; FIG. 3A) and at least one side wall 354 extending from the lower surface 352 to the forming surface 310. Accordingly, the slow-cooling channel 350 may have a height 'h' between the lower surface 352 and the upper surface 330, and a width 'w' between a pair of side walls 354 extending from the lower surface 352 to the upper surface 330.

In one form of the present disclosure, and as depicted in FIGS. 3 and 3A, the slow-cooling channel 350 may be hollow, i.e., the slow-cooling channel 350 is a vacant space (e.g., air) bounded by the lower surface 352 and at least one side wall 354. It should be understood that heat transfer from the heated PHS blank 105 to the cavity surface 322 and/or the upper surface 330 of the quench die 30 is greater than heat transfer from the heated PHS blank 105 to the hollow slow-cooling channel 350. Accordingly, during die quenching a first portion of the heated PHS blank 105 positioned adjacent to and in contact with the forming cavity surface 322 and/or upper surface 330 has a first cooling rate and a second portion of the heated PHS blank 105 positioned adjacent to the slow-cooling channel 350 has a second cooling rate that is less than the first cooling rate.

In some aspects, the first cooling rate results in the heated PHS blank 105 transforming from an austenitic microstructure to a martensitic microstructure and the second cooling rate results in the heated PHS blank 105 transforming from an austenitic microstructure to a ferritic microstructure. For example, the first cooling rate may be greater than about 10 degrees Celsius per second (° C./s) and less than about 200° C./s, and the second cooling rate may be less than about 10° C./s and greater than about 0.1° C./s. Particularly, the first cooling rate may be greater than about 20° C./s and less than about 100° C./s. In one aspect, the first cooling rate is between about 20° C./s and about 40° C./s, for example between about 20° C./s and about 30° C./s or between about 30° C./s and about 40° C./s. In another aspect, the first cooling rate is between about 40° C./s and about 60° C./s, for example between about 40° C./s and about 50° C./s or between about 50° C./s and about 60° C./s. In still another aspect, the first cooling rate is between about 60° C./s and about 80° C./s, for example between about 60° C./s and about 70° C./s or between about 70° C./s and about 80° C./s. In still yet another aspect, the first cooling rate is between about 80° C./s and about 100° C./s, for example between about 80° C./s and about 90° C./s or between about 90° C./s and about 100° C./s. Also, the first cooling rate may be between about 100° C./s and about 200° C./s, for example between about 100° C./s and about 150° C./s or between about 150° C./s and about 200° C./s. It should be understood that other first cooling rates not specifically listed may result from die quenching the heated PHS blank 105 at step 220 with the quench die 30 so long as the PHS blank 210 transforms from an austenitic microstructure to a martensitic microstructure.

Regarding the second cooling rate, in some examples, the second cooling rate is less than about 6° C./s and greater than about 0.2° C./s. In one aspect, the second cooling rate is between about 6° C./s and about 3° C./s. In another aspect, the second cooling rate is between about 3° C./s and about 1° C./s. In still another aspect, the second cooling rate is between about 1° C./s and about 0.2° C./s. It should be understood that other second cooling rates not specifically listed may result from die quenching the PHS blank at step 220 with the quench die 30 so long as the PHS blank transforms from an austenitic microstructure to a ferritic microstructure.

Still referring to FIG. 3A, the height h and the width w may be set or designed such that a desired second cooling rate is provided for a portion of the heated PHS blank 105 positioned adjacent to the slow-cooling channel 350 during die quenching. That is, the dimensions of the height h and width w determine the volume of air within the hollow slow-cooling channel 350, the heat flux from the heated PHS blank 105 to the slow-cooling channel 350, the amount of heat radiation from the heated PHS blank 105 to the lower surface 352 and/or at least one side wall 354, and the like. In one aspect, the height h of the slow-cooling channel 350 may be between about 1 t and about 100 t and the width w of the slow-cooling channel 250 may be between about 1 t and about 50 t where 't' is the thickness (Y direction) of the PHS blank 105. In some aspects, the height h of the slow-cooling channel 350 may be between about 5 t and about 50 t, for example between about 5 t and about 10 t, between about 10 t and about 15 t, between about 15 t and about 20 t, between about 20 t and about 25 t, between about 25 t and about 30 t, between about 30 t and about 35 t, between about 35 t and about 40 t, between about 40 t and about 45 t, or between about 45 t and about 50 t. Also, the width w of the slow-cooling channel 350 may be between about 5 t and about 35 t, for example between about 5 t and about 10 t, between about 10 t and about 15 t, between about 15 t and about 20 t, between about 20 t and about 25 t, between about 25 t and about 30 t, or between about 30 t and about 35 t. It should be understood that the slow-cooling channel 350 may have a height or width outside of the ranges listed above so long as the slow-cooling channel 350 results in a cooling rate of an adjacent portion of a heated PHS blank 105 to transform from an austenitic microstructure to a ferritic microstructure during die quenching of the heated and formed PHS blank 105.

Regarding the thickness t of the PHS blank 105, in some examples, the thickness t of the PHS blank 105 may be between about 0.4 mm and about 2.0 mm, for example between about 0.4 mm and about 0.6 mm, between about 0.6 mm and about 0.8 mm, between about 0.8 mm and about 1.0 mm, between about 1.0 mm and about 1.2 mm, between about 1.2 mm and about 1.4 mm, between about 1.4 mm and about 1.6 mm, between about 1.6 mm and about 1.8 mm, or between about 1.8 mm and about 2.0 mm. It should be understood that thicknesses of PHS blanks 105 not specifically listed may be used to from PHS parts 220 using the quench dies and methods disclosed herein.

Figure 4:
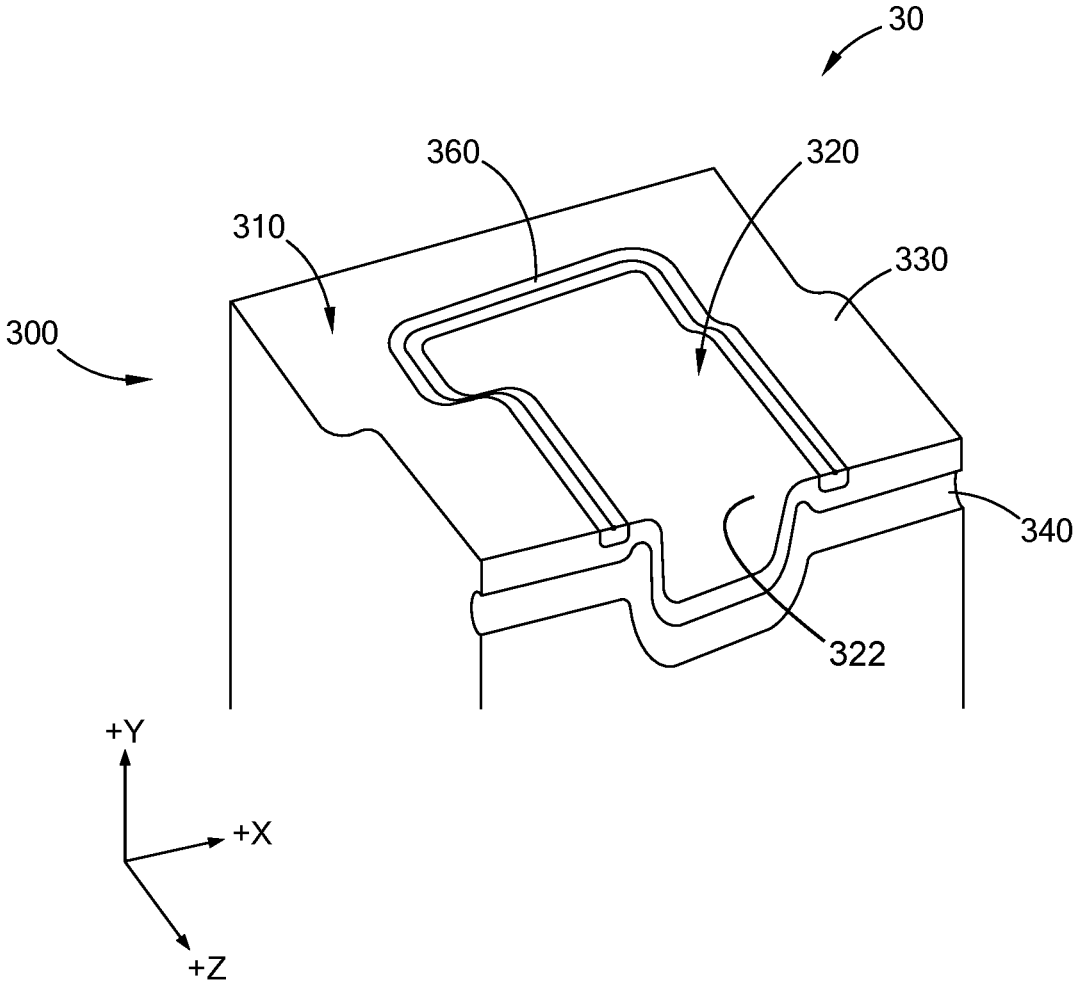
FIG. 4 is a perspective view of a quench die according to another variation in accordance with the teachings of the present disclosure.

While FIG. 3 schematically depicts the slow-cooling channel 350 in the form of a hollow slow-cooling channel 350, the slow-cooling channel 350 may not be hollow and may be filled or occupied with a low thermal conductivity material other than a gas such as air. For example, and with reference to FIG. 4, the quench die 30 may include at least one slow-cooling channel 360 filled or occupied with a ceramic material that has a lower thermal conductivity than the forming surface 310. Non-limiting examples of ceramic materials include alumina, silica, mullite, silicon nitride, and the like. In one aspect, the at least one slow-cooling channel 360 may have the same width w and height h as the at least one hollow slow-cooling channel 350 (FIG. 3A). In another aspect, the at least one slow-cooling channel 360 may have a different width w and/or a different height h than the at least one hollow slow-cooling channel 350. In either aspect, the at least one slow-cooling channel 360 results in a second cooling rate of a portion of the heated PHS blank 105 positioned adjacent to the at least one slow-cooling channel 360 that is less than the first cooling rate of the heated PHS blank 105 positioned adjacent to the forming surface 310. Also, the second cooling rate for the slow-cooling channel 360 may be the same or different than the second cooling rates listed above with respect to the slow-cooling channel 350 so long as the second cooling rate results in the austenitic microstructure of the heated PHS blank 105 being transformed to a ferritic microstructure upon die quenching of the heated PHS blank 105.

Figure 6A:
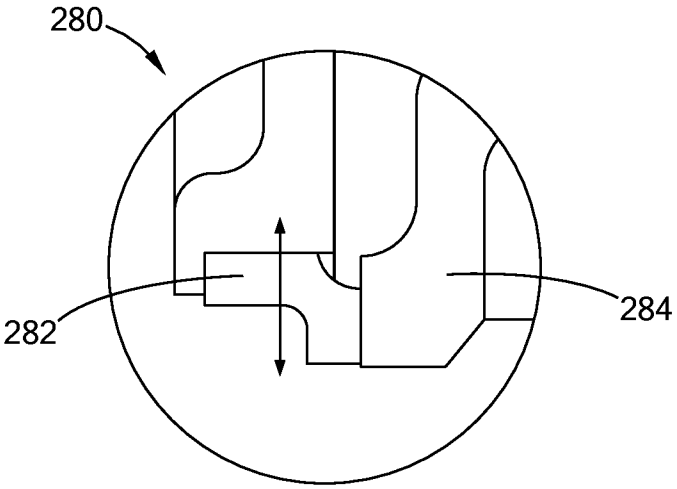
FIG. 6A is a detail view of section A-A in FIG. 5.
Figure 6B:
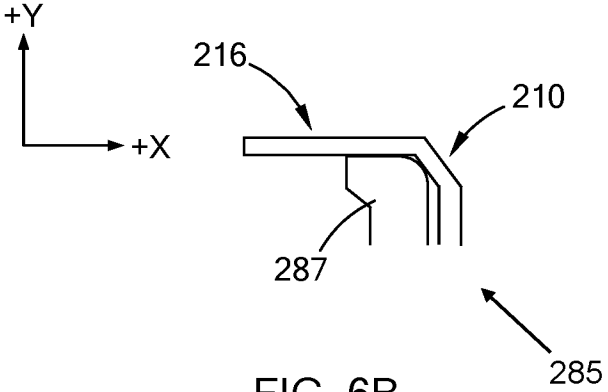
FIG. 6B is a detail view of section B-B in FIG. 5.
Figure 5:
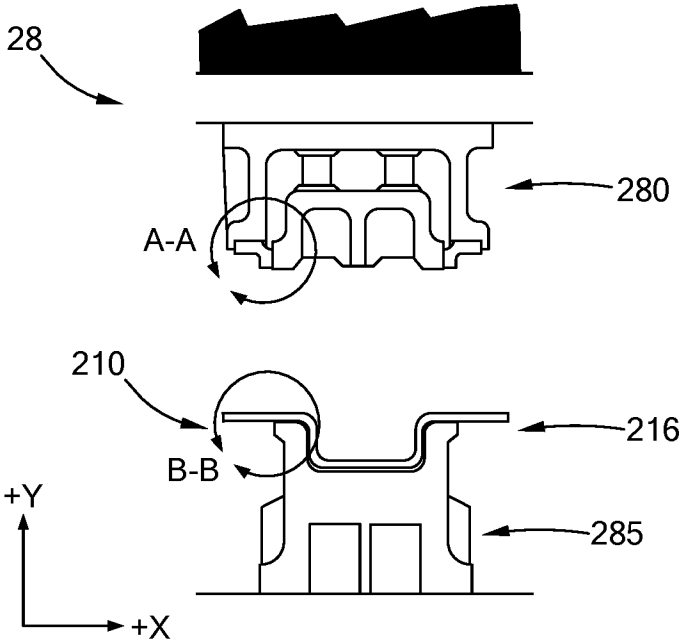
FIG. 5 is a side view of the trimming die in FIG. 2 constructed in accordance with the teachings of the present disclosure.

Referring now to FIGS. 5, 6A and 6B, a PHS panel 210 having been transferred to the die trimming station 28 is schematically depicted in FIG. 5, and enlarged views of sections A-A and B-B in FIG. 5 are schematically depicted in FIGS. 6A and 6B, respectively. Particularly, FIG. 5 schematically depicts the PHS panel 210 positioned between a trim die 280 and a bolster 285. The PHS panel 210 has a trim portion 216 extending outwardly from a hot formed portion (not labeled) of the PHS panel 210. In some aspects, the trim portion 216 extends along a periphery of the PHS panel 210. The trim die 280 includes a cutting member 282 (FIG. 6A) and a trim pad 284 that abuts and provides support to the cutting member 282. The bolster 285 includes a trim area support 287. The trim die 280 moves downward (−Y direction) towards the bolster 285 such that the trim pad 284 comes into contact with and securely holds the PHS panel 210 in a fixed position while the cutting member 282 moves downwardly (−Y direction) and shears the trim portion 216 to remove excess material from the PHS panel 210. However, and unlike the PHS panel 110 formed according to the prior art process 10 (FIG. 1), the PHS panel 210 formed according to the process 20 has a localized soft zone that is sheared by the cutting member 282 without excessive wear thereto.

Figure 7:
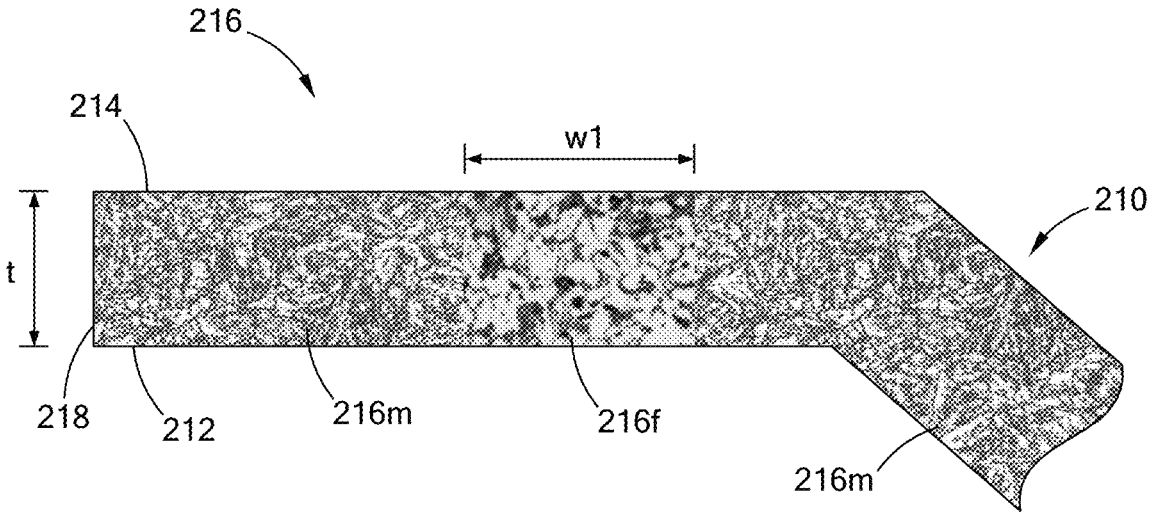
FIG. 7 is a side cross-sectional view of a portion of a PHS part before being trimmed according to the teachings of the present disclosure.

Referring now to FIG. 7, the trim portion 216 may include a ferritic portion **216*f* formed by cooling of the PHS panel 210 adjacent to the slow-cooling channel 350 or 360 at the second cooling rate. That is, the localized soft zone comprises the ferritic portion 216*f*. In one aspect, the ferritic portion 216*f* may extend between a lower surface 212 (−Y direction) and an upper surface 214 (+Y direction) of the PHS panel 210 and be positioned between a pair of martensitic portions 216*m* (hard zones) as schematically depicted in FIG. 7. In such an aspect, the ferritic portion 216*f* may have a width 'w1' extending between the pair of martensitic portions 216*m*. It should be understood that the width w1 may be generally equal to or less than the width w of the slow-cooling channel 350 or 360. In another aspect (not shown), the ferritic portion 216*f* may extend outwardly from a martensitic portion 216*m* to an outer edge 218 of the trim portion 216. That is, the ferritic portion 216*f* schematically depicted in FIG. 7 may extend from the martensitic portion 216*m* on the righthand side (+X direction) of the trim portion 216 to the outer edge 218**.

Still referring to FIG. 7, it should be understood that the pair of martensitic portions **216*m* bounding the ferritic portion 216*f* correspond to portions of the PHS panel 210 positioned in direct contact with the forming surface 310 of the quench die 30 and thereby are cooled at the first cooling rate. Accordingly, the pair of martensitic portions 216*m* are cooled at a sufficiently fast cooling rate such that the austenitic microstructure of the PHS panel 210 before die quenching is transformed to a martensitic microstructure after die quenching. It should also be understood that the ferritic portion 216*f* corresponds to a portion of the PHS panel 210 positioned adjacent to the slow-cooling channel 350 or the slow-cooling channel 360 of the quench die 30 and thereby is cooled at the second cooling rate. That is, the ferritic portion 216*f* is cooled at a sufficiently slow cooling rate such that the austenitic microstructure of the PHS panel 210** before die quenching is transformed to a ferritic microstructure during die quenching.

Figure 8:
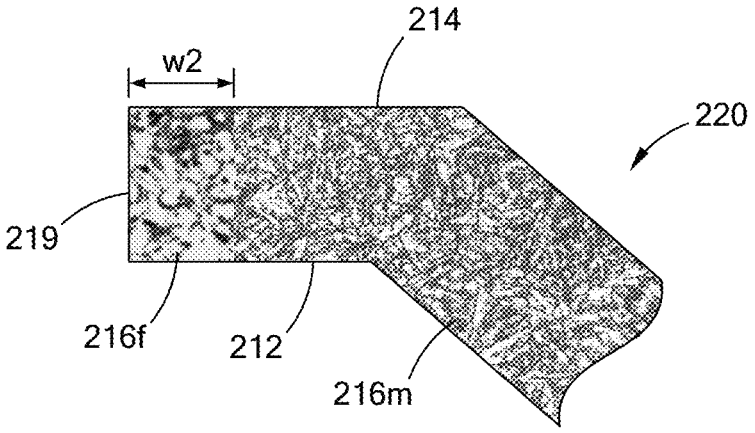
FIG. 8 is a side cross-sectional view of a portion of a PHS part after being trimmed according to the teachings of the present disclosure.

Referring now to FIG. 8, and as noted above, the cutting member 282 moves downward (−Y direction) and shears the trim portion 216 within the ferritic portion **216*f* and thereby forms a sheared edge 219. That is, excess material is removed from the PHS panel 210 and the ferritic portion 216*f* extends from the martensitic portion 216*m* on the righthand side (+X direction) to the sheared edge 219. Accordingly, the ferritic portion 216*f* has a second width w2 that is less than the first width w1 of the ferritic portion 216*f* before shearing by the cutting member 282. It should be understood that in some aspects, the cutting member 282 may completely remove or shear the excess material from the PHS panel 210, while in other aspects, the cutting member 282 may not completely remove or shear the excess material from the PHS panel 210, i.e., the trim portion 216** may be partially sheared and the excess material may be removed later, e.g., by hand, with a separate machine, etc.

The present disclosure enables conventional die trimming of PHS blanks that have been hot stamped and die quenched. The PHS blanks are die quenched with a quench die comprising a slow-cooling channel. A portion of a PHS blank positioned adjacent to the slow-cooling channel during die quenching has a cooling rate that results in a localized soft zone with a ferritic microstructure, and reduced hardness and strength, compared to a remaining portion of the PHS panel that has a martensitic microstructure. The reduced hardness and strength of the localized soft zone allow for die trimming of the PHS panel using conventional trimming die steels without excessive wear of the trimming die. Accordingly, expensive and/or time-consuming laser trimming of the PHS panels may be avoided thereby lowering time and cost for the manufacture of PHS parts.

As used herein the term "about" refers to measurement errors or uncertainties of values disclosed herein when measured using known instruments, techniques, and the like. Also, the terms "upper" and "lower" when used with the term surface or surfaces refer to a location or relative position shown in the drawings and are not meant to describe or limit such surfaces to an exact configuration, orientation or position unless stated otherwise.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method comprising:

hot stamping and die quenching a blank with a quench die comprising at least one slow-cooling channel and forming a die quenched panel, wherein the at least one slow-cooling channel comprises at least one hollow slow-cooling channel with a vacant space bounded by a lower surface and at least one side wall in the at least one slow-cooling channel, and the die quenched panel comprises at least one localized soft zone adjacent to at least one hard zone; and die trimming the die quenched panel along the at least one localized soft zone.

2. The method of claim 1, wherein the blank is formed from a press hardenable steel (PHS).

3. The method of claim 2, wherein the at least one localized soft zone of the die quenched panel comprises a microhardness between about 200 HV and about 250 HV, and the at least one hard zone of the die quenched panel comprises a microhardness between about 400 HV and about 500 HV.

4. The method of claim 2, wherein the at least one soft zone comprises a ferritic microstructure and the at least one hard zone comprises a martensitic microstructure.

5. The method of claim 4, wherein during die trimming the die quenched panel along the at least one localized soft zone, the at least one localized soft zone comprises a temperature between about 400° C. and about 650° C., and the at least one hard zone comprises a temperature less than about 200° C.

6. The method of claim 1, wherein the at least one localized soft zone comprises less than about 10% by volume of the die quenched panel and the at least one hard zone comprises more than about 90% by volume of the die quenched panel.

7. The method of claim 1, wherein the blank has a thickness 't' and the at least one localized soft zone comprises a width between about 5 t and about 20 t.

8. The method of claim 1, further comprising a step of transferring the die quenched panel from a die quench station to a die trim station with a transfer unit.

9. The method of claim 8, wherein the transfer unit comprises a support for the at least one localized soft zone of the die quenched panel during transfer of the die quenched panel from the die quench station to the die trim station.

10. The method of claim 9, wherein the transfer unit is a heated transfer unit.

11. A method of forming a part from press hardenable steel (PHS), the method comprising:

hot stamping a PHS blank in a quench die comprising at least one slow-cooling channel and forming a hot stamped PHS blank, wherein the at least one slow-cooling channel comprises at least one hollow slow-cooling channel with a vacant space bounded by a lower surface and at least one side wall in the at least one slow-cooling channel;

die quenching the hot stamped PHS blank at a die quench station and forming a die quenched PHS panel, wherein the die quenched PHS panel comprises a hard zone with a martensitic microstructure and at least one localized soft zone with a ferritic microstructure;

transferring the die quenched PHS panel from the die quench station to a die trimming station using a transfer unit, wherein the transfer unit comprises at least one of a support for the at least one localized soft zone and a heating element for providing heat to the at least one localized soft zone;

die trimming the die quenched PHS panel along the at least one localized soft zone at the die trimming station and forming a PHS part; and cooling the die trimmed PHS part to room temperature.

12. The method of claim 11, wherein the hard zone comprises more than about 90% by volume and the at least one soft zone comprises less than about 10% by volume of the die trimmed PHS part.

13. The method of claim 11, wherein the at least one localized soft zone of the die trimmed PHS part comprises a microhardness between about 200 HV and about 250 HV, and the hard zone of the die trimmed PHS part comprises a microhardness between about 400 HV and about 500 HV.

14. The method of claim 11, wherein during die trimming the die quenched PHS panel along the at least one localized soft zone, the at least one localized soft zone comprises a temperature between about 400° C. and about 650° C., and the hard zone comprises a temperature between about 25° C. and about 200° C.

15. The method of claim 11, wherein die trimming the die quenched PHS panel along the at least one localized soft zone forms a die trimmed edge comprising a ferritic microstructure.

16. The method of claim 11, wherein the PHS blank comprises a thickness 't' and the at least one localized soft zone comprises a width between about 5 t and about 20 t.

* * * * *